US006616061B1

(12) United States Patent
Penny

(10) Patent No.: US 6,616,061 B1
(45) Date of Patent: Sep. 9, 2003

(54) RAILWAY OR TRAMWAY RAIL AND RAIL FASTENING SYSTEM

(76) Inventor: Charles Penny, 27 Victoria Park Rd., Malvern, Worchestershire WR14 21X (GB)

( * ) Notice: Subject to any disclaimer, the term of this patent is extended or adjusted under 35 U.S.C. 154(b) by 0 days.

(21) Appl. No.: 09/701,073

(22) PCT Filed: May 28, 1999

(86) PCT No.: PCT/GB99/01705

§ 371 (c)(1),
(2), (4) Date: Nov. 21, 2000

(87) PCT Pub. No.: WO99/63160

PCT Pub. Date: Sep. 12, 1999

(51) Int. Cl.[7] ..... E01B 1/00
(52) U.S. Cl. ..... 238/7; 104/2
(58) Field of Search ..... 238/2, 3, 5, 7; 104/2

(56) References Cited

U.S. PATENT DOCUMENTS 4,775,103 A 10/1988 Ortwein
5,788,153 A * 8/1998 Ortwein ..... 238/7

FOREIGN PATENT DOCUMENTS

| | | |
|---|---|---|
| DE | 41 14 803 A1 | 11/1992 |
| DE | 44 27 237 A1 | 2/1996 |
| DE | 196 04 887 A1 | 8/1997 |
| GB | 2 272 011 A | 10/1992 |

* cited by examiner

*Primary Examiner*—S. Joseph Morano
*Assistant Examiner*—Robert J. McCarry, Jr.
(74) *Attorney, Agent, or Firm*—Hahn Loeser + Parks LLP; Stephen L. Grant

(57) ABSTRACT

A railway or tramway rail fastening system includes a shell (2) and a resilient fill (4) within the shell for holding a rail (1), the shell having an inner profile open channel form to receive the rail, the inner profile being shaped to hold firmly, through the fill (4), the head and base region and/or an intermediate portion of the rail. The arrangement is such that pinch points are produced which hold the rail in place.

68 Claims, 5 Drawing Sheets

RAILWAY OR TRAMWAY RAIL AND RAIL FASTENING SYSTEM

Figure 1:
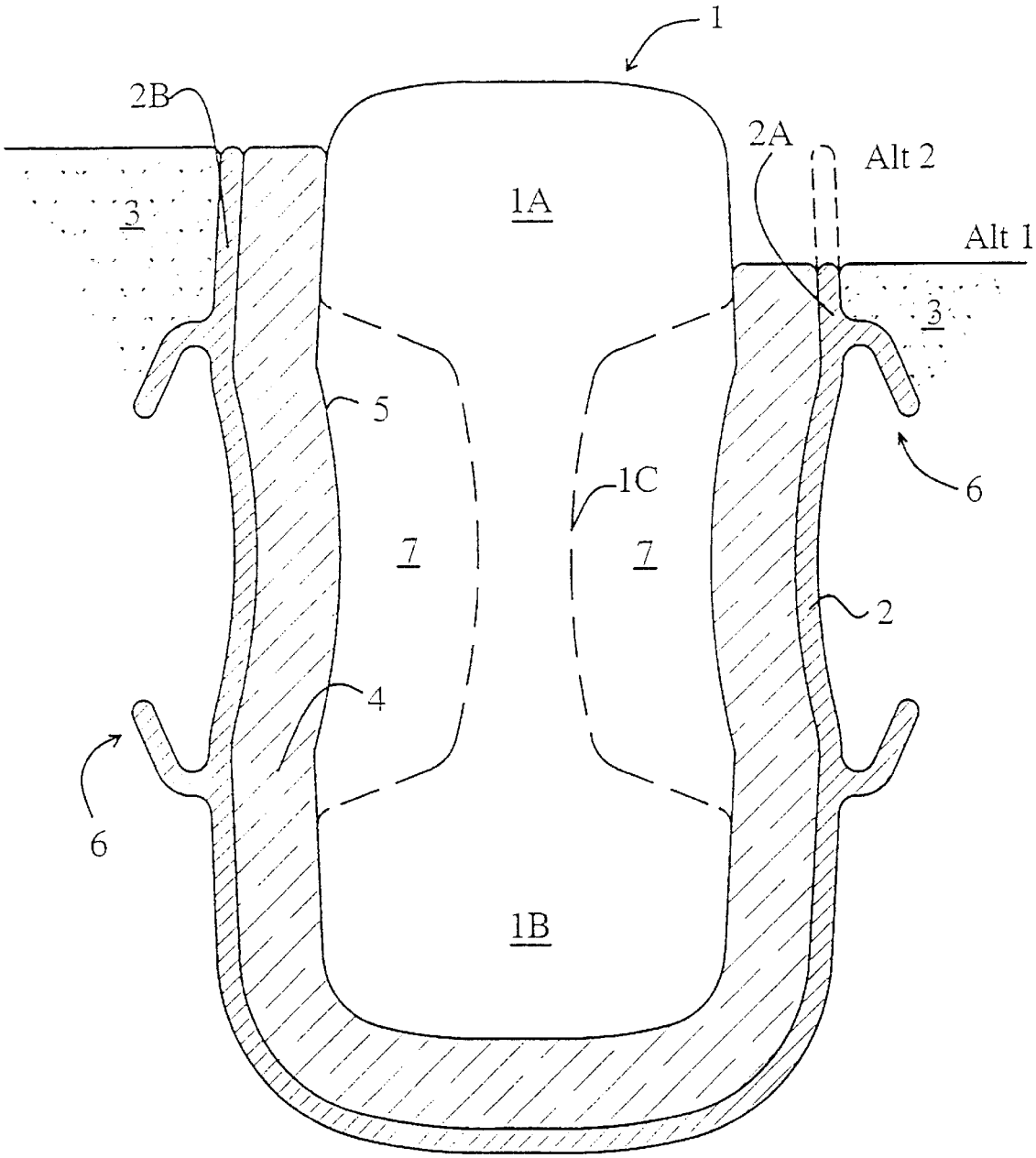

This invention relates to a railway or tramway rail fastening system including a rail and a shell for holding a railway or tramway rail.

Great Britain application 2,272,011 (May 4, 1994) discloses a tramway rail which is secured in place by a split shell containing an infill.

According to one aspect of the present invention, there is provided a railway or tramway fastening system, comprising a shell and a resilient fill within the shell for holding a railway or tramway rail having a head, a web and a base region and the shall having an inner profile of open channel form to receive the rail, the inner profile of the shell at its upper, open side and at its lower base side being shaped to hold firmly, through the fill the head and base region, respectively, of the rail; characterized in that the inner profile of the shell between the base and the open side is narrowed so as to form a detent or pinch point through which a region of the rail has to be passed upon insertion of the rail into the shell to retain the rail.

According to a second aspect of the present invention, there is provided a railway or tramway fastening system, comprising a shell and a resilient fill within the shell for holding a railway or tramway rail of substantially symmetrical form having head and base portions joined by an intermediate portion of greater girth, the shell having an inner profile of open channel form to receive the rail and the inner profile of the shell intermediate its upper, open side and its lower, base side being shaped to hold firmly through the fill, the intermediate portion of the rail; characterized in that the inner profile of the shell between its base and the open side is narrowed so as to form a detent or pinch point through which a region of the rail has to be passed upon insertion of the rail into the shell to retain the rail.

The fill can be of stiff and strong but resilient material such as an elastomer. The fill can be bonded to the shell and/or to the rail or can be provided as a sheet for forcing into the shell upon insertion of the rail or can be poured, cast or sprayed into the space between the shell and rail.

The inner profile of the shell can be straight or curved in the lengthwise direction thereof to match a given longitudinal or vertical straightness or curvature respectively of the rail to be held in the shell.

The inner profile of the shell can be pre-profiled to match the given longitudinal straightness or curvature of the rail to be held in the shell. This pre-profiling can be achieved by applying bending forces to the shell, which forces can be applied within the inner profile and/or against the exterior of the shell.

The material of the shell is preferably stiffer than the elastomer inside it and can be of sheet material or pulltruded, extruded, moulded or cast, for example of polymer concrete, sheet metal, fibre-reinforced thermosetting resin or of fibre-reinforced thermoplastics.

The rail itself could be used to provide the required support and bending forces to the shell. Alternatively, individual formers, e.g. short lengths of rail or rail profiled material, can be located inside and/or outside of the shell to provide the required bending forces and alignment during installation.

Preferably, the shell is laid and/or set in a supporting bed or slab of, for example, concrete or asphalt.

A railway or tramway track will comprise two such shells located side-by-side and can be formed as a unified slab construction. Alternatively, the two shells can have a tie piece between them.

According to a third aspect of the present invention, there is provided a railway or tramway rail fastening system including at least one shell with resilient fill, the or each shell being essentially as defined according to the first or second aspect of the invention and the or each shell having a rail held firmly therein by the combination of fill and shell.

The rail may be substantially symmetrical in cross section so that when its head becomes worn the rail can be removed from the shell, inverted and replaced in the shell to provide a second head for use. The two rails of a track can also be changed over one for the other.

According to a fourth aspect of the present invention, there is provided a method of laying a railway or tramway rail using a shell with resilient fill essentially as defined according to the first or second aspect of the invention and causing a rail to be held firmly therein, the rail being held securely in position by the combination of fill and shell.

According to a fifth aspect of the present invention, there is provided a railway or tramway rail, the rail having a longitudinal profile including a bulged portion when viewed in cross-section, said bulged portion acting as a detent when inserted into a surrounding fastening system essentially as defined according to the first or second aspect of the invention to hold the rail in place.

The bulged portion may be in intermediate upper and lower regions of the rail or the bulged portion may be in a lower and/or upper region of the rail. This enables ease of rail replacement with minimum disruption to the remainder of the system.

The overall cross-section of the rail maybe substantially rectangular and the sides of the rail maybe provided with not just one bulged portion but two or three bulged portions, extending from the head of the rail towards its base, so as to provide a ribbed formation along the sides of the rail. With such a configuration, a webless and/or footless rail is effectively produced, thereby allowing more side wear allowance and less frequent rail change, whilst reducing corrosion sensitivity and stresses within the rail.

This comparatively simple cross-section with no web allows ultrasonic testing of the whole rail in a satisfactory manner and not just the head of the rail as at present. This is intended to avoid checking delays by identifying flaws before they cause an unplanned delay.

Such a cross-section is also intended to reduce sensitivity to inherent or load-generated defects or manufacturing defects such as inclusions and fractures. In addition, the comparatively wide head provides a greater bearing area for the wheel and the wider, and therefore more solid, webless cross-section permits sliding expansion joints to be more robust.

Finally, it is well known that noise is generated by passage of the trains on webbed rails and with the proposed cross-section, the webless rail is expected significantly to reduce noise output.

In a further development, at least one seal in the form of an elastomeric strip may be wedged between the shell and the rail in a region where there is no fill in order to give further support to the rail.

Figure 2:
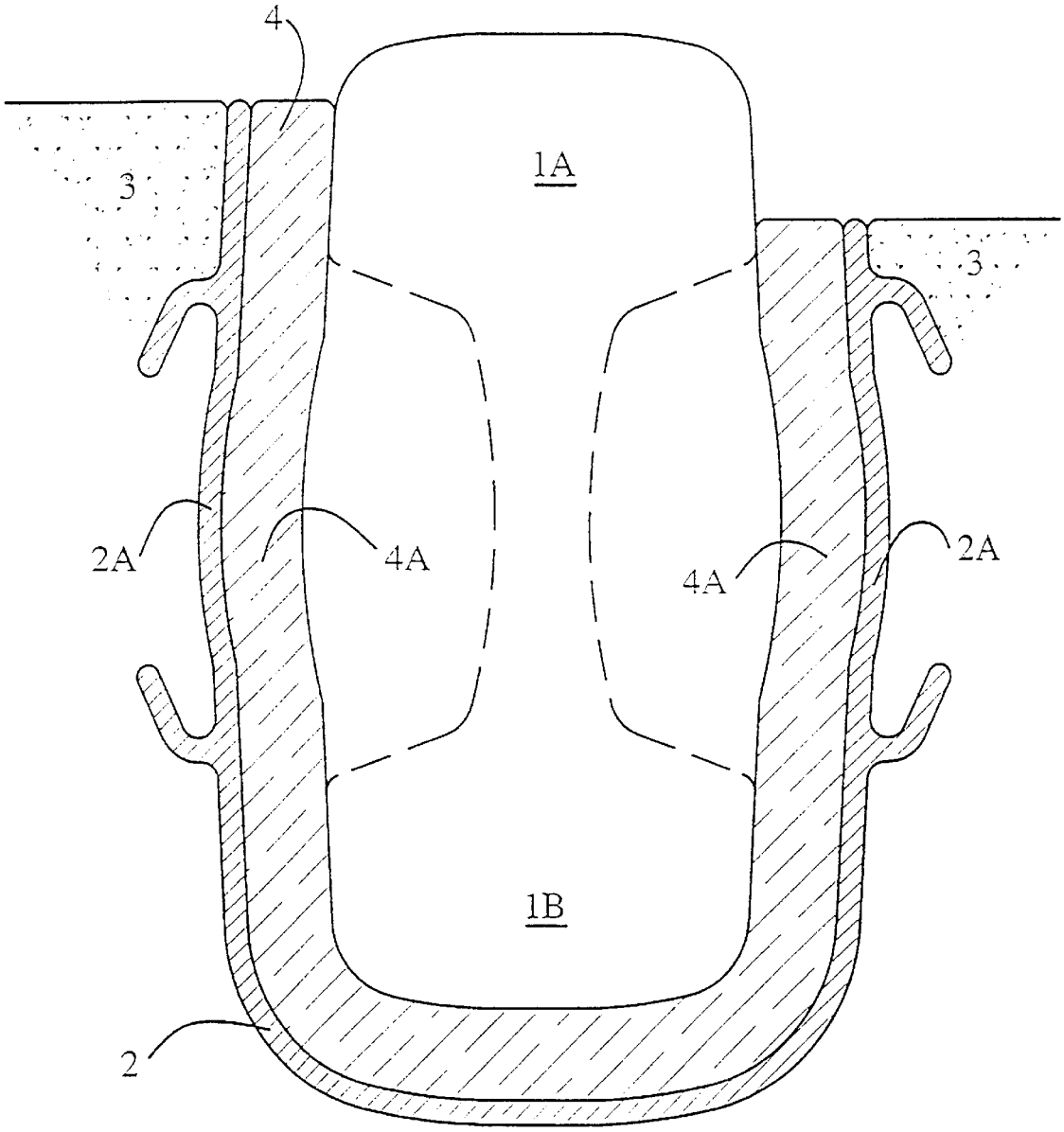
Figure 4:
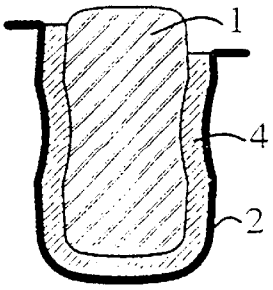
Figure 5:
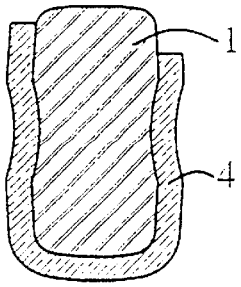
Figure 6:
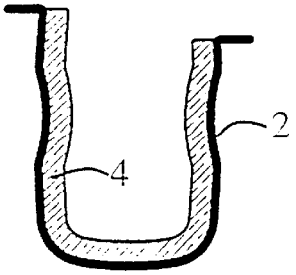
Figure 7:
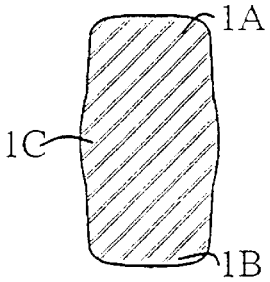
Figure 3:
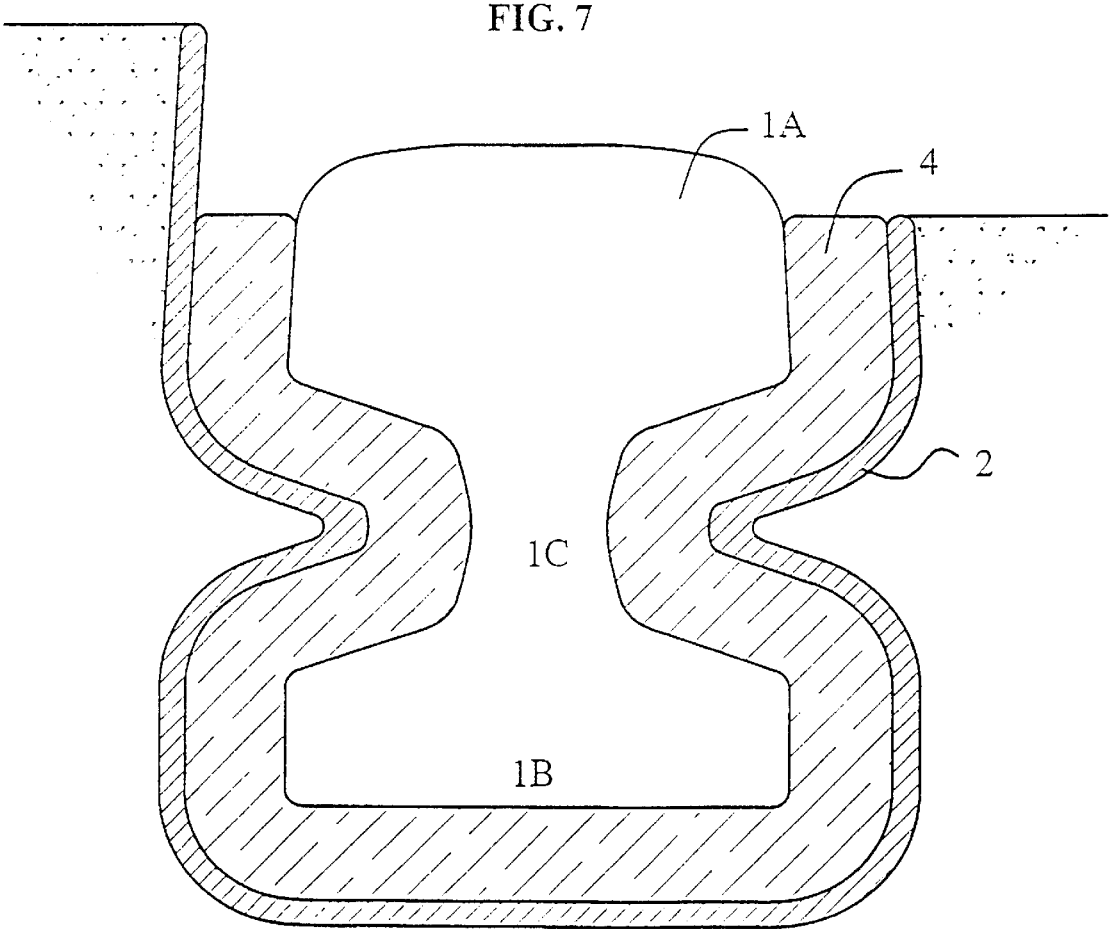
Figure 8:
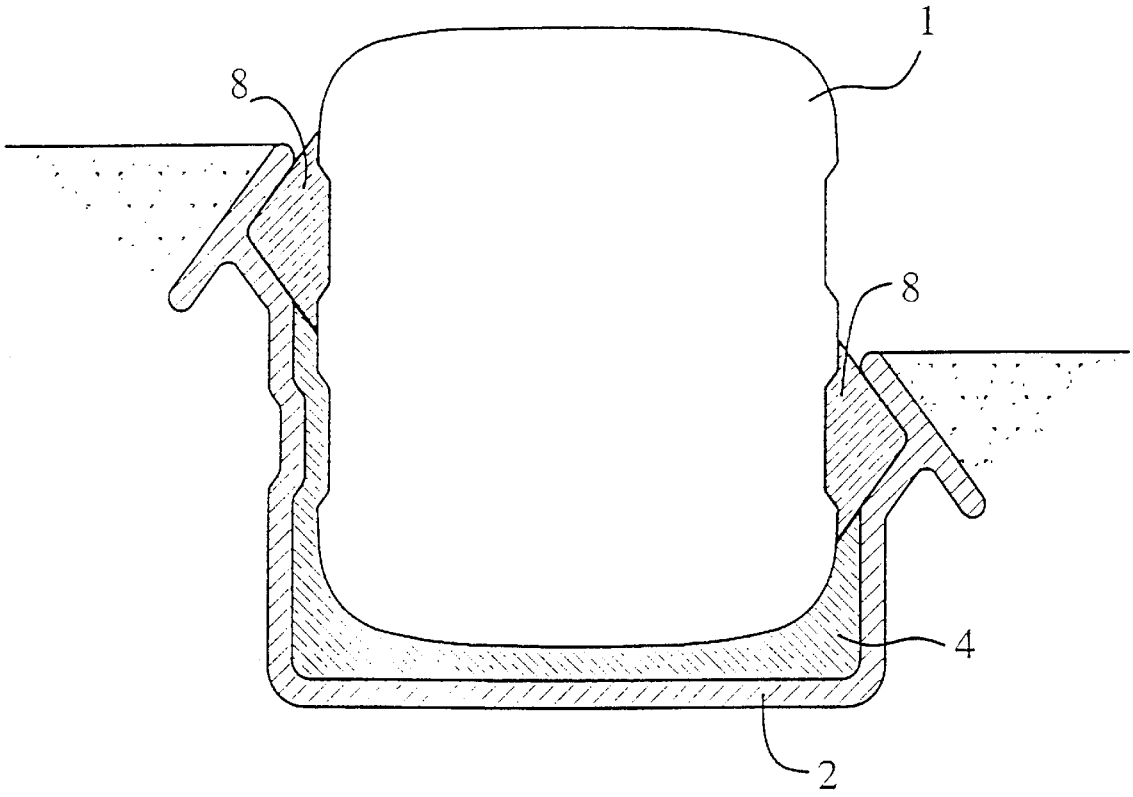
Figure 9:
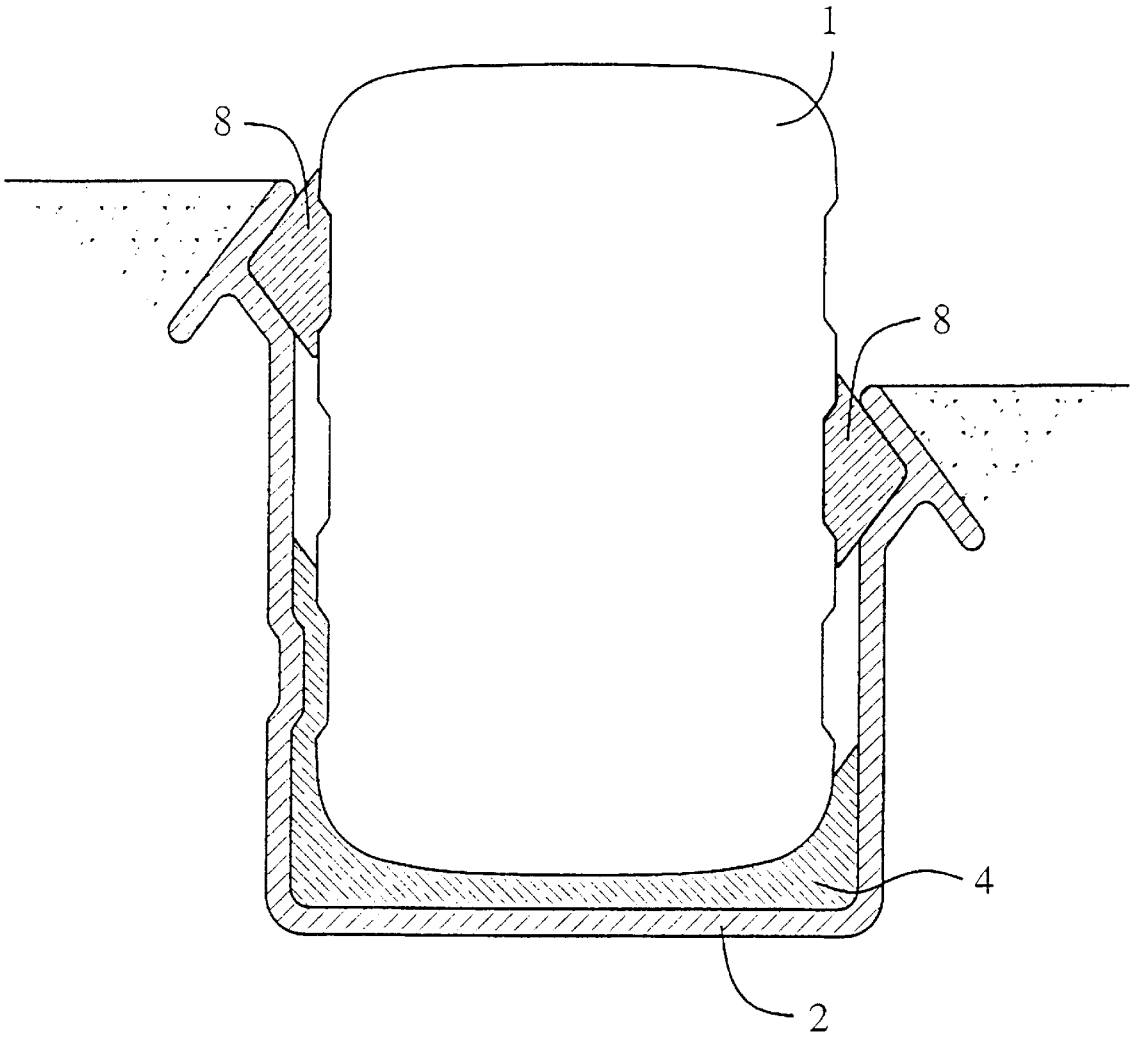

For a better understanding of the invention and to show how the same may be carried into effect, reference will now be made by way of example, to the accompanying drawings, in which:

FIG. 1 is a diagrammatic sectional view of a railway or tramway fastening system, FIG. 2 is a view similar to FIG. 1 showing a shell with its fill in accordance with the second aspect of the invention defined above, FIG. 3 is a diagrammatic sectional view of another profile which the shell can take to accommodate a modified flanged rail, FIGS. 4, 5 and 6 are diagrammatic sectional views illustrating three possible approaches to the supply and manufacture of the system, and FIG. 7 is a diagrammatic sectional view of a preferred profile of rail to be received in the shell of FIG. 2, and FIGS. 8 and 9 are views similar to FIG. 2 showing two further possible profiles of rail and shell.

FIG. 1 shows, by way of example, a railway rail 1 held in a shell 2 set in a bed or slab 3 of concrete. The shell 2 has an inner profile of open channel form to receive the rail 1 and the inner profile of the shell at its upper, open side and at its lower, base side being shaped to hold firmly through the intermediary of a resilient fill 4 the head 1A and base region 1B of the rail 1.

The inner profile of the shell 2 between its base and its open side is narrowed so that the inner profile of the resilient fill at 5 forms a pinch point through which the base 1B has to be passed upon insertion of the rail 1 into the shell 2. This narrowing means that the rail 1 must be effectively sprung into the shell as a type of snap-action/detent effect. Removal of the rail for replacement or inversion requires a similar spring snap-action to be overcome. As FIG. 1 shows, the rail 1 is substantially symmetrical to allow for such inversion.

It will be noted that one wall 2A is lower than the other wall 2B to allow for the passage of the flange of a wheel of a railed vehicle, whilst maintaining support for the head 1A of the rail on both sides.

The lengthwise profile of the shell 2 is arranged to follow the longitudinal profile of the rail to be laid therein, whether the rail is straight or curves in horizontal and/or vertical planes.

The required profile of the shell 2 can be achieved in a number of ways. For example, a shell 2 containing its layer of fill 4 can be taken and set to the correct curve (and cant in the case of a track with parallel rails) using inserts in the form of short lengths of rail or wood, for example, of the same profile as the final rail. The inserts such as the dummy rail pieces can have rods connected to them so that the inserts can be twisted, for example, to achieve the desired curvature of the shell or can be raised or lowered for vertical and horizontal alignment.

The material of the shell 2 is thereby twisted and the surrounding concrete material 3 is then poured and allowed to set, thereby maintaining the shell in its formed alignment profile. Protrusions 6 can be provided to ensure bonding of the shell with the concrete and so that the shell 2 can be gripped externally by temporary lifting grips (not shown) engaging with the protrusions 6 so that the pre-profiled shell can be moved to the location where it is to be incorporated in the concrete. To enhance bonding of the shell to surrounding concrete and/or the shell to the elastomer fill, the shell surface(s) can be given a roughened texture.

Another possibility would be to apply external bending forces to the shell 2 to achieve the required profile and level of cant, in which case the fill 4 can be provided later inside the shell.

This system lends itself to the formation of either slip-formed, in situ, or precast slab track, where for example slabs of concrete five metres long are manufactured and incorporate parallel shells 2, which are then taken to site and the rails are inserted after installation of the slabs. The rails could be inserted at the point of manufacture if an economic length can be transported.

On site, the rails can be welded together, dowels or other joiners can be used to join the pre-cast slabs accurately and grout holes or grout "tubes á manchete" can be made in the slab to provide vertical alignment adjustment during installation and/or operation.

For railway track replacement, where at present ballasted track is in place, where there is for example a 600 mm depth of ballast, the top 300 mm of ballast could be taken out and could be recycled, with even the concrete sleepers being crushed to provide concrete for its slab track or to form a firm bed and the slab track as described above could be laid on top of the crushed concrete.

The regions 7 in FIG. 1 either side of the web of the rail could be part of the solid steel rail or could be filled with rubber or another polymer material which can be but need not be bonded to the rail and/or shell.

It will be appreciated that with the present system the rail is physically squeezed into the shell and is sprung into place, whilst the head 1A is held and at the same time resilience offered to the rail is maintained to its base 1B, there being a constant and even base region area which is resiliently supported by the shell itself. The thickness of the elastomer can be controlled to give the correct resilience at all locations whilst keeping resilient material costs to a minimum. The shells 2 of a track form barriers to spurious electrical connection between the rails and a good rough surface and positive mechanical interlocking can be provided where appropriate to ensure good concrete/shell bond and shell/elastomer bond.

FIG. 2 illustrates a variation in the profile of the shell 2 and fill 4 to receive a reversible rail of the form shown in FIG. 7 which has identical head and base regions 1A, 1B joined by an intermediate bulged portion 1C. Accordingly, the portions 2A and 4A of the shell and fill, respectively, intermediate the open end and the lower, base side of the shell are correspondingly bulged or flared.

The rail of FIG. 7 is therefore snapped into position, the central bulged portion 1C having overcome the restraint of the entry into the shell at its open end.

The actual rail illustrated in FIG. 2 is of the same form as that shown in FIG. 1, to illustrate the point that both profiles of rail can be accepted by this particular profile of shell and fill with the rail still being satisfactorily held firmly in place.

FIG. 3 illustrates a different form of shell with its fill of elastomeric material and shaped to accommodate a flanged rail with the flange and web being illustrated at 1B and 1C. Since the shell and its polymer provide adequate support and resilience for the rail along the whole of the underside of the flange 1B, the flange is not so wide as would normally be the case with conventional railway rail only supported on sleepers.

FIG. 4 diagrammatically illustrates how the system can be pre-manufactured and delivered to site ready for setting down. Here, the shell 2 is delivered with its fill 4 already encasing the rail 1.

FIG. 5 illustrates the rail 1 with the layer of fill 4 already bonded to it. In this case, the shell 2 is already cast in its concrete base or slab and the rail with its fill coating is forced into the pre-aligned shell.

FIG. 6 shows that the fill 4 can be initially bonded to the inner profile of the shell 2 and then can be delivered to site for subsequent rail insertion.

Reverting to FIG. 7, the profile of rail illustrated there can also be the profile utilised, along with the shells, in the variations illustrated in FIGS. 4, 5 and 6.

In practice, the shell 2 can be set in the concrete either by pre-alignment as described earlier, with the concrete poured about the shell or the concrete can be poured and the shell can be vibrated down in it.

The fill 4 can be poured or otherwise coated and bonded on the shell and/or rail or it could be in the form of, for example, a rubber sheet which can be arranged to straddle the open side of the shell and be forced into the shell at the time of insertion of the rail.

FIGS. 8 and 9 illustrate profiles of rail which are developed from the cross-section of rail illustrated in FIG. 7.

It will be noted that both the more squat form of rail shown in FIG. 8 and the form of rail shown in FIG. 9 are provided with ribbed configurations along their sides, into which can be fitted one or more profiled elastomeric gaskets or seals 8 in order to give further support to the rail.

The method of assembly in this case could follow the steps of providing the shell 2, dropping the elastomeric base fill 4 into the base of the shell 2, dropping/forcing the rail 1 onto the fill 4 and inserting the seals 8, firstly by inserting one profiled seal 8 on one side of the rail, then pulling the rail sideways to compress that seal 8 to allow space for insertion of the second seal 8 finally releasing the rail which then achieves the desired position.

The present system has the benefits of easy installation and easy replacement with no loose fittings thereby requiring little inspection as compared with conventional railway track. It has a higher performance, not least in holding the head of the rail steady, whilst maintaining the required vertical resilience up and down and laterally, reducing noise pollution and enhancing safety. It permits automatic rerailing in the event of derailment, nominal inspection, maintenance or faults to reduce delays to traffic.

The reversible rail has the benefit of cost, time and material savings.

Regarding the elastomer fill 4, the thickness of it can be controlled to give correct vertical and lateral resilience at all locations whilst keeping material costs to the minimum and the shell provides a barrier to highly alkaline concrete which will serve to protect the elastomer. The shell 2 also serves to protect the elastomer during shipping and handling and also provides protection against the forces required to align the rail, e.g. when the system is gripped by utilising the shell which accordingly avoids gripping or compressing the elastomer fill 4.

The whole system in its various forms can also be used for tramway rail.

What is claimed is:

1. A railway or tramway rail fastening system, for setting in a slat or a bed, said fastening system comprising:

a rail for a railway or a tramway, said rail having a head, a narrower intermediate portion and a base region;

a shell adapted to be set in the slab or bed, the shell having an inner profile of open channel form to receive the rail, the inner profile of the shell being shaped at an upper, open side and at a lower, base side to hold the rail firmly at the head and base thereof, respectively; and a resilient fill within the shell, the shell acting through the fill to hold the rail;

characterized in that the inner profile of the shell between its base and the open side is narrowed so as to form a detent or pinch point through which a region of the rail has to be passed upon insertion of the rail into the shell to retain the rail.

2. The system according to claim 1, wherein the fill is bonded to at least one of the shell and the rail.

3. The system according to claim 1, wherein the fill is bonded to the shell and/or the rail.

4. The system according to claim 1, wherein the fill is a sheet material.

5. The system according to claim 1, wherein the inner profile of the shell is pre-profiled to match the given longitudinal straightness or curvature of the rail to be held in the shell.

6. The system according to claim 1, wherein the material of the shell is stiffer than the fill and has been formed out of sheet material, by pulltruding, extruding, molding or by casting.

7. The system according to claim 1, wherein at least one elastomeric seal is provided for sealing the open side of the shell against the rail.

8. The system according to claim 7, wherein the shell is shaped to firmly support the rail through the fill and the seals.

9. The system according to claim 1, wherein the rail is formed with inserts at either side of the intermediate web portion.

10. The system according to claim 9, wherein the inserts are bonded to at least one of the rail and shell.

11. The system according to claim 9, wherein the inserts are formed of rubber or another polymer material.

12. A method of laying a railway or tramway rail, comprising the steps of:

providing a fastening system as defined in claim 1; and fitting the rail into the shell, the rail being held securely in position by the combination of fill and shell.

13. The method according to claim 12 further comprising inserting at least one elastomeric, profiled seal between the rail and shell in a region where there is no fill.

14. The method according to claim 12 further comprising the step of laying or setting the shell in a supporting bed or slab of concrete.

15. The method according to claim 12 further comprising the step of aligning the shell before a supporting bed or slab of concrete is poured and allowed to set.

16. The method according to claim 12 further comprising the step of inserting the fill and the rail into the shell before it is set in a supporting bed or slab of concrete.

17. The method according to claim 12 further comprising the step of inserting the fill into the shell before it is set in a supporting bed or slab of concrete, and inserting the rail later.

18. The method according to claim 12 further comprising the step of inserting the rail with the fill bonded thereto, after the shell is set in a supporting bed or slab of concrete.

19. The method according to claim 12 further comprising the step of fixing the shell by vibrating the shell down into a mixture of liquid concrete, and allowing the concrete to set.

20. The method according to claim 12 further comprising the step of dropping the fill into the base of the shell, inserting the rail into the shell, inserting a first seal on one side of the rail, pulling the rail sideways to compress the first seal, inserting a second seal and releasing the rail into its desired position.

21. The method according to claim 12 further comprising the steps of fitting a rail, subsequently removing the rail, reversing the rail, and refitting the rail.

22. The method according to claim 12, wherein two rails are fitted into two shells, the method further comprising the steps of subsequently removing the rails, changing the rails over one for the other, and refitting the rails.

23. The system according to claim 1, further comprising:

at least one protrusion on an outer surface of the shell for facilitating bonding of the shell in the slab or bed.

24. A railway or tramway rail fastening system, for setting in a slab or a bed, said fastening system comprising:

a rail for a railway or a tramway, said rail being of substantially symmetrical form having head and base portions joined by an intermediate portion of greater girth;

a shell adapted to be set in slab or bed, the shell having an inner profile of open channel form to receive the rail, the inner profile of the shell being shaped intermediate an upper, open side and a lower, base side to hold the rail firmly at the intermediate portion thereof; and a resilient fill within the shell, the shell holding the rail through the fill;

characterized in that the inner profile of the shell at the open side is narrowed so as to form a detent or pinch point through which the intermediate portion of the rail has to be passed upon insertion of the rail into the shell to retain the rail.

25. The system according to claim 24, wherein the fill is bonded to at least one of the sheet and the rail.

26. The system according to claim 2, wherein the fill is a sheet material.

27. The system according to claim 24, wherein at least one elastomeric seal is provided for sealing the open side of the shell against the rail.

28. The system according to claim 27, wherein the shell is shaped to firmly support the rail through the fill and the seals.

29. The system according to claim 24, wherein the rail is formed with inserts at either side of an intermediate web portion.

30. The system according to claim 29, wherein the inserts are bonded to at least one of the rail and shell.

31. A railway or tramway rail, the rail having a longitudinal profile including a bulged portion when viewed in cross-section, said bulged portion acting as a detent that co-operates with the detent of the shell when inserted into the surrounding fastening system according to claim 2 to hold the rail in place.

32. The rail according to claim 31, wherein the bulged portion is in intermediate upper and lower portions of the rail or is in a lower and/or upper region of the rail.

33. A method of laying a railway or tramway rail, comprising the steps of:

providing a fastening system as defined in claim 24; and fitting the rail into the shell, the rail being held securely in position by the combination of fill and shell.

34. The method according to claim 33 further comprising inserting at least one elastomeric, profiled seal between the rail and shell in a region where there is no fill.

35. The method according to claim 33 further comprising the step of laying or setting the shell in a supporting bed or slab of concrete.

36. The method according to claim 33 further comprising the step to aligning the shell before a supporting bed or slab of concrete is poured and allowed to set.

37. The method according to claim 33 further comprising the step of inserting the fill and the rail into the shell before it is set in a supporting bed or slab of concrete.

38. The method according to claim 33 further comprising the step of inserting the fill into the shell before it is set in a supporting bed or slab of concrete, and inserting the rail later.

39. The method according to claim 33 further comprising the step of inserting the rail with the fill bonded thereto, after the shell is set in a supporting bed or slab of concrete.

40. The method according to claim 33 further comprising the step of fixing the shell by vibrating the shell down into a mixture of liquid concrete, and allowing the concrete to set.

41. The method according to claim 33 further comprising the step of dropping the fill into the base of the shell, inserting the rail into the shell, inserting a first seal on one side of the rail, pulling the rail sideways to compress the first seal, inserting a second seal and releasing the rail into its desired position.

42. The method according to claim 33 further comprising the steps of fitting a rail, subsequently removing the rail, reversing the rail, and refitting the rail.

43. The method according to claim 33, wherein two rails are fitted into two shells, the method further comprising the steps of subsequently removing the rails, changing the rails over one for the other, and refitting the rails.

44. The system according to claim 24, further comprising:

at least one protrusion on an outer surface of the shell for facilitating bonding of the shell in the slab or bed.

45. A railway or tramway rail fastening system, for setting in a slab or a bed, said fastening system comprising:

a rail for a railway or a tramway, said rail having a head, at least one narrower intermediate portion and a base region;

a shell adapted to be set in the slab or bed, the shell having an inner profile of open channel form to receive the rail, the inner profile of the shell being shaped at a lower, base end thereof to hold at least the base region of the rail firmly; and a resilient fill within the shell, the shell holding the rail through the fill;

characterized in that seals are provided at the upper, open end of the shell, the inner profile of the shell being shaped at is upper, open end to hold the rail, at the sides thereof, firmly though the seals; and in that the inner profile of the shell between its base and the open end is narrowed so as to form a detent or pinch point through which a region of the rail has to be passed upon insertion of the rail into the shell to retain the rail.

46. The system according to claim 45, wherein the detent or pinch point is formed by a rib on one side of the shell.

47. The system according to claim 45, wherein the fill is bonded to at least one of the shell and the rail.

48. The system according to claim 1, wherein the fill is sheet material.

49. The system according to claim 1, wherein the shell is higher on one lateral side than on the other.

50. The system according to claim 45, wherein the rail is substantially symmetrical, in cross-section, about a vertical axis.

51. The system according to claim 50, wherein the rail is substantially symmetrical, in cross-section, about a horizontal axis.

52. The system according to claim 51, wherein the rail is substantially rectangular in cross-section.

53. The system according to claim 52, wherein the rail is ribbed along its sides.

54. A railway or tramway rail, the rail having a longitudinal profile including a bulged portion when viewed in cross-section, said bulged portion acting as a detent that co-operates with the detent of the shell when inserted into the surrounding fastening system according to claim 24 to hold the rail in place.

55. The rail according to claim 54, wherein the bulged portion is in intermediate upper and lower regions of the rail or is in a lower and/or upper region of the rail.

56. The rail according to claim 54, that is substantially rectangular in cross-section.

57. The rail according to claim 55, wherein the rail has a ribbed configuration.

58. A method of laying a railway or tramway rail, comprising the steps of:

providing a fastening system as defined in claim 45; and fitting the rail into the shell, the rail being held securely in position by the combination of fill, shell and seals.

59. The method according to claim 58 further comprising the step of laying or setting the shell in a supporting bed or slab of concrete.

60. The method according to claim 58 further comprising the step to aligning the shell before a supporting bed or slab of concrete is poured and allowed to set.

61. The method according to claim 58 further comprising the step of inserting the fill and the rail into the shell before it is set in a supporting bed or slab of concrete.

62. The method according to claim 58, further comprising the step of inserting the fill into the shell before it is set in a supporting bed or slab of concrete, and inserting the rail later.

63. The method according to claim 58 further comprising the step of inserting the rail with the fill bonded thereto, after the shell is set in a supporting bed or slab of concrete.

64. The method according to claim 58 further comprising the step of fixing the shell by vibrating the shell down into a mixture of liquid concrete, and allowing the concrete to set.

65. The method according to claim 58 further comprising the step of dropping the fill into the base of the shell, inserting the rail into the shell, inserting a first seal on one side of the rail, pulling the rail sideways to compress the first seal, inserting a second seal and releasing the rail into its desired position.

66. The method according to claim 58 further comprising the steps of fitting a rail, subsequently removing the rail, reversing the rail, and refitting the rail.

67. The method according to claim 58, wherein two rails are fitted into two shells, the method further comprising the steps of subsequently removing the rails, changing the rails over one for the other, and refitting the rails.

68. The system according to claim 45, further comprising:

at least one protrusion on an outer surface of the shell for facilitating bonding of the shell in the slab or bed.

* * * * *